US008602258B2

(12) United States Patent
Long et al.

(10) Patent No.: US 8,602,258 B2
(45) **Date of Patent: *Dec. 10, 2013**

(54) TOP OR BOTTOM LOADING CONTAINER

(75) Inventors: Leslie Thomas Long, Appleton, WI (US); Daniel Studd Grubb, Jr., Appleton, WI (US); Michael Alan Hermans, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 1121 days.

This patent is subject to a terminal disclaimer.

(21) Appl. No.: 12/079,743

(22) Filed: Mar. 27, 2008

(65) Prior Publication Data

US 2008/0210704 A1 Sep. 4, 2008

Related U.S. Application Data

(63) Continuation of application No. 10/933,892, filed on Sep. 4, 2004, now Pat. No. 7,377,391.

(51) Int. Cl.

| | |
|---|---|
| ***A47K 10/42*** | (2006.01) |
| ***A47K 10/24*** | (2006.01) |
| ***B65D 5/72*** | (2006.01) |
| ***B65D 5/54*** | (2006.01) |
| ***B65D 83/08*** | (2006.01) |
| ***B65H 1/00*** | (2006.01) |
| ***B65H 3/00*** | (2006.01) |

(52) U.S. Cl.
USPC ..... 221/63; 221/307; 221/33; 221/47; 221/305

(58) Field of Classification Search
USPC ..... 221/305, 33, 47, 63, 64, 307
See application file for complete search history.

(56) References Cited

U.S. PATENT DOCUMENTS

| | | | |
|---|---|---|---|
| 715,620 | A | 12/1902 | Staude |
| 1,223,232 | A | 4/1917 | Ash |
| 2,549,970 | A | 4/1951 | Howard |
| 2,890,791 | A | 6/1959 | Wenzel |
| 3,036,729 | A | 5/1962 | Asman |
| 3,243,078 | A | 3/1966 | Pherson |
| 3,254,793 | A | 6/1966 | Palmer |
| 3,346,141 | A | 10/1967 | Pherson et al. |
| 3,384,224 | A | 5/1968 | Buckholz et al. |
| 3,979,019 | A | 9/1976 | Bliss |
| 4,262,816 | A | 4/1981 | Margulies |
| 4,413,769 | A | 11/1983 | Michetti |
| 4,459,127 | A | 7/1984 | Kunzel |
| 4,540,091 | A | 9/1985 | Habock |
| 4,768,679 | A | 9/1988 | Matsui |

(Continued)

FOREIGN PATENT DOCUMENTS

EP 0 587 132 A1 3/1994

*Primary Examiner* — Michael K Collins
(74) *Attorney, Agent, or Firm* — Kimberly-Clark Worldwide, Inc.

(57) ABSTRACT

A container including: a container top having a dispensing opening formed from a plurality of top flaps; a container bottom disposed opposite the container top formed from a plurality of bottom flaps; and a plurality of decorative panels forming a sidewall of the container having a continuous decorative surface. The container is formed from a substantially symmetrical blank. As a result, the container can be loaded from either end on a cartoner. The container's continuous decorative surface on the sidewall allows for graphics on the container's sidewall to continue unimpeded. Advantageously, the container is designed for use on high speed cartoners and can be filled from either the top or the bottom as required.

6 Claims, 6 Drawing Sheets

(56) References Cited

U.S. PATENT DOCUMENTS

| | | | | |
|---|---|---|---|---|
| 4,877,154 | A | 10/1989 | Matsui | |
| 5,215,757 | A | 6/1993 | El Nokaly | |
| 5,599,555 | A | 2/1997 | El Nokaly | |
| 5,860,555 | A | 1/1999 | Mayled | |
| 5,980,931 | A | 11/1999 | Fowler et al. | |
| 6,121,165 | A | 9/2000 | Mackey et al. | |
| 6,349,849 | B1 | 2/2002 | Pehr | |
| 6,591,989 | B2 | 7/2003 | McNeill | |
| 6,910,600 | B2 | 6/2005 | Keberlein | |
| 7,377,391 | B2 * | 5/2008 | Long et al. | 206/494 |
| 2001/0052477 | A1 | 12/2001 | McNeill | |
| 2003/0205613 | A1 | 11/2003 | Schliebner et al. | |
| 2004/0144795 | A1 * | 7/2004 | Keberlein | 221/45 |
| 2006/0049067 | A1 | 3/2006 | McDonald | |

* cited by examiner

TOP OR BOTTOM LOADING CONTAINER

This application is a continuation application of U.S. Ser. No. 10/933,892 filed Sep. 4, 2004 now U.S. Pat. No. 7,377, 391. The entirety of U.S. Ser. No. 10/933,892 is hereby incorporated by reference.

BACKGROUND

Increasingly, producers of consumer use product containers, such as facial tissue cartons, are making maximum use of the container surface area through the use of full face graphics, specialized graphics, including three dimensional, lenticular, holographic, laminated films, foils and other printed, photographic and digital effects. The increased use of such graphics creates a desire for the minimization of visible boundaries at the meeting point of edges to maximize the visual effect of the printed graphics.

Also, in the manufacture of containers, or any other die cut process, minimizing the amount of material needed to produce a given sized container is a cost saving goal. The savings in materials consumed corresponds to a direct savings in manufacturing costs, and more efficient production. It is highly desirable to have a container construction that decreases the amount of container material required to construct a container having the same functionality.

Moreover, to fill a container on a manufacturing line with a product, such as loading a facial tissue carton with a clip of facial tissues, the carton design must be compatible with high speed automated machinery. Hand loading or manual packaging of the facial tissue into the carton is not practical due to the excessive labor costs involved and the inherently slow rates of operation when compared to an automated process.

Therefore, a need exists for a carton that has a continuous decorative surface on its sidewall to maximize the graphical appeal of the carton with a minimum of design interruptions and that can be top or bottom loaded on high speed automated packaging equipment.

SUMMARY

The inventors have discovered that by relocating the closure flaps used to fill a container from the sides or sidewall of the container, to the top and bottom of the container, a container having a continuous decorative surface on the sidewall can be constructed. Because the closing flaps are now on the top and bottom of the container, the container can be loaded from either the top or bottom as needed. Additionally, by designing the blank that forms the container to be substantially symmetrical about its longitudinal center line, the resulting container is more compatible with automated carton loading equipment. In various embodiments of the invention, the shape of the top flaps and the closing sequence of the flaps can be adapted to achieve a variety of visual appearances. In another embodiment of the invention, the container can be adapted to be refilled or used as a sleeve to house a refill carton placed into the container.

Hence, in one aspect, the invention resides in a container including: at least three decorative panels forming a continuous decorative surface that extends in side-fold continuity across a plurality of edges where adjacent decorative panels meet except at an edge where the first decorative panel is joined to the last decorative panel, the decorative panels forming a sidewall of the container; a plurality of top flaps extending from the decorative panels and folded to form a container top having at least a portion of a dispensing opening located in the container top; a plurality of bottom flaps extending from the decorative panels and folded to form a container bottom disposed opposite the container top; and wherein a blank from which the container is formed is substantially symmetrical about a longitudinal center line of the blank.

In another aspect, the invention resides in a container including: at least four decorative panels forming a continuous decorative surface that extends in side-fold continuity across a plurality of edges where adjacent decorative panels meet except at an edge where the first decorative panel is joined to the fourth decorative panel, the decorative panels forming a sidewall of the container; a plurality of top flaps extending from the decorative panels and folded to form a container top having a dispensing opening, the plurality of folded top flaps comprising two oppositely disposed major top flaps and two oppositely disposed minor top flaps; a plurality of bottom flaps extending from the decorative panels and folded to form a container bottom disposed opposite the container top; wherein at least a portion of the dispensing opening is located in each major top flap such that when the two major top flaps are folded closed they form the dispensing opening; and wherein the dispensing opening has a major axis and a minor axis with the minor axis of the dispensing opening intersecting the oppositely disposed minor top flaps on the container top.

In yet another aspect, the invention resides in a container including: at least four decorative panels forming a continuous decorative surface that extends in side-fold continuity across a plurality of edges where adjacent decorative panels meet except at an edge where the first decorative panel is joined to the fourth decorative panel, the decorative panels forming a sidewall of the container; a plurality of top flaps extending from the decorative panels and folded to form a container top having a dispensing opening, the plurality of folded top flaps comprising two oppositely disposed major flaps and two oppositely disposed minor flaps; a plurality of bottom flaps extending from the decorative panels and folded to form a container bottom disposed opposite the container top; at least a portion of the dispensing opening is located in each major top flap such that when the two major top flaps are folded closed they form the dispensing opening, and a dispensing window wherein at least a portion of the dispensing window is located in each major top flap such that when the two major top flaps are folded closed they from a dispensing orifice; and wherein on at least one of the major top flaps, the dispensing window ends short of a distal end of that major flap.

BRIEF DESCRIPTION OF THE DRAWINGS

The above aspects and other features, aspects, and advantages of the present invention will become better understood with regard to the following description, appended claims, and accompanying drawings in which:

Figure 1:
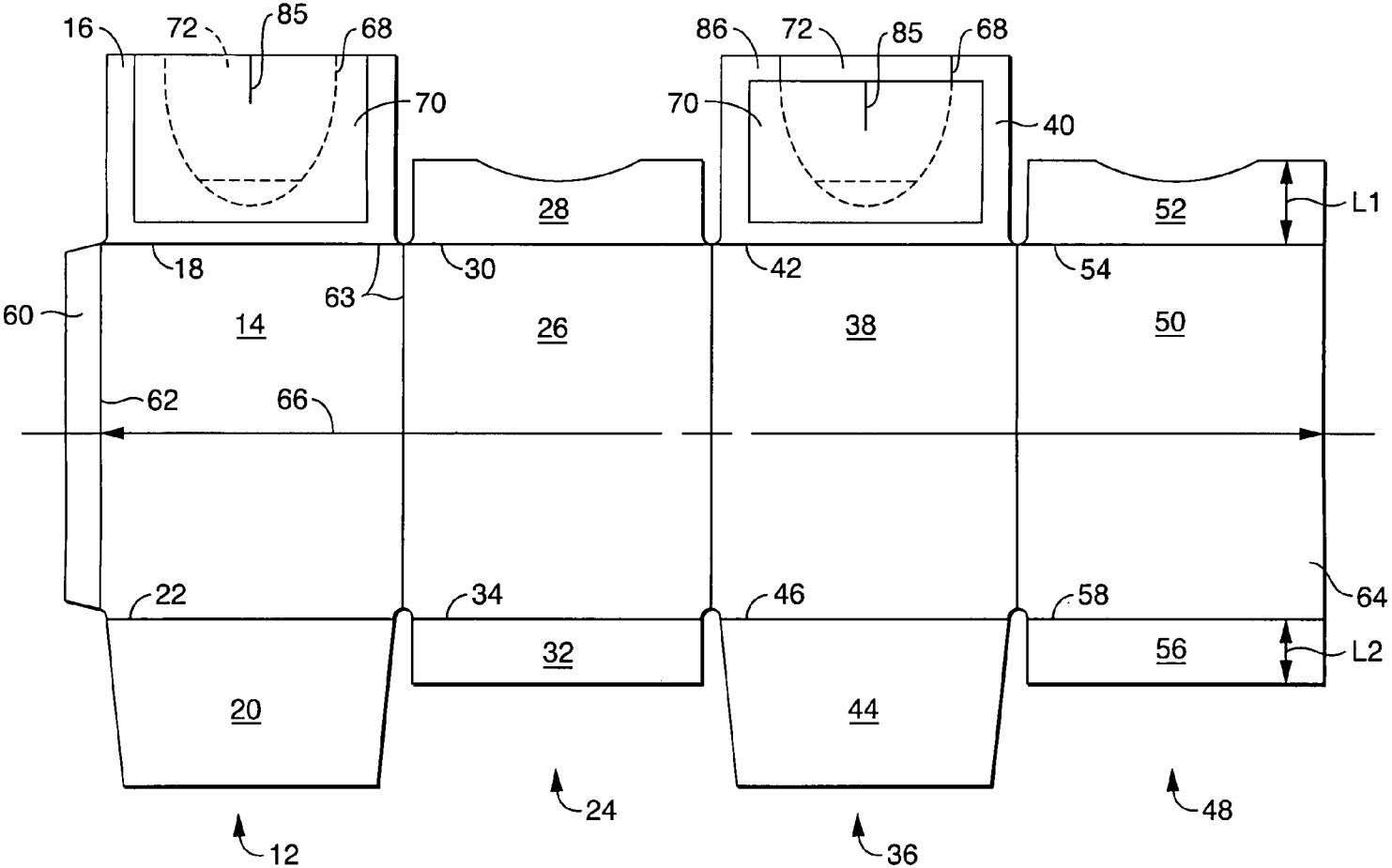
FIG. 1 illustrates a top view of a container blank in accordance with one embodiment of the invention.

Repeated use of reference characters in the specification and drawings is intended to represent the same or analogous features or elements of the invention in different embodiments.

DEFINITIONS

As used herein forms of the words "comprise", "have", and "include" are legally equivalent and open-ended. Therefore, additional non-recited elements, functions, steps or limitations may be present in addition to the recited elements, functions, steps, or limitations.

As used herein, "sheet material" is a flexible substrate, which is useful for household chores, cleaning, personal care, health care, food wrapping, and cosmetic application or removal. Non-limiting examples of suitable substrates for use with the dispenser include nonwoven substrates; woven substrates; hydro-entangled substrates; air-entangled substrates; paper substrates comprising cellulose such as tissue paper, toilet paper, or paper towels; waxed paper substrates; coform substrates comprising cellulose fibers and polymer fibers; wet substrates such as wet wipes, moist cleaning wipes, moist toilet paper wipes, and baby wipes; film or plastic substrates such as those used to wrap food; shop towels; and metal substrates such as aluminum foil. Furthermore, laminated or plied together substrates of two or more layers of any of the preceding substrates are also suitable.

As used herein, "wet sheet material" includes substrates that are either wet or pre-moistened by an appropriate liquid, partially moistened by an appropriate liquid, or substrates that are initially dry but intended to be moistened prior to use by placing the substrate into an appropriate liquid such as water or a solvent. Non-limiting examples of suitable wet substrates include a substantially dry substrate (less than 10% by weight of water) containing lathering surfactants and conditioning agents either impregnated into or applied to the substrate such that wetting of the substrate with water prior to use yields a personal cleansing product. Such substrates are disclosed in U.S. Pat. No. 5,980,931 entitled Cleansing Products Having A Substantially Dry Substrate issued to Fowler et al. on Nov. 9, 1999. Other suitable wet sheet materials can have encapsulated ingredients such that the capsules rupture during dispensing or use. Examples of encapsulated materials include those disclosed in U.S. Pat. No. 5,215,757 entitled Encapsulated Materials issued to El-Nokaly on Jun. 1, 1993, and U.S. Pat. No. 5,599,555 entitled Encapsulated Cosmetic Compositions issued to El-Nokaly on Feb. 4, 1997. Other suitable wet sheet materials include dry substrates that deliver liquid when subjected to in-use shear and compressive forces. Such substrates are disclosed in U.S. Pat. No. 6,121,165 entitled Wet-Like Cleaning Articles issued to Mackay et al. Sep. 19, 2000.

As used herein an "upright dispenser" is a dispenser that dispenses sheet materials that have been assembled into a clip and the clip folded prior to insertion into the dispenser. In one embodiment, the upright dispenser comprised a facial tissue carton made from board stock having an overall height of approximately 127 mm and a footprint or bottom of approximately 110 mm by 110 mm that formed a parallelepiped having a generally cubical shape.

DETAILED DESCRIPTION

It is to be understood by one of ordinary skill in the art that the present discussion is a description of exemplary embodiments only, and is not intended as limiting the broader aspects of the present invention, which broader aspects are embodied in the exemplary construction.

FIG. 1 is a top plan view of a blank, generally indicated by the numeral 10 for a container in accordance with one embodiment of the present invention. The inside surface of the blank or the resulting container's interior surface is illustrated. In one embodiment, the container was a facial tissue carton suitable for housing a plurality of facial tissue sheets. The blank can be sized to form either upright cartons or flat cartons. Additionally, the blank and the resulting container can be used to house other suitable sheet materials. The blank 10 includes a first section 12 having a first section decorative panel 14, a first section top flap 16 disposed at a first end 18 of the first section decorative panel and a first section bottom flap 20 disposed at a second end 22 of the first section decorative panel. Blank 10 further includes a second section 24 connected to first section 12, the second section having a second section decorative panel 26, a second section top flap 28 disposed at a first end 30 of the second section decorative panel and a second section bottom flap 32 disposed at a second end 34 of the second section decorative panel. The blank 10 still further includes a third section 36 connected to second section 24, the third section having a third section decorative panel 38, a third section top flap 40 disposed at a first end 42 of the third section decorative panel and a third section bottom flap 44 disposed at a second end 46 of the third section decorative panel. The blank 10 still further includes a fourth section 48 connected to third section 36, the fourth section having a fourth section decorative panel 50 and a fourth section top flap 52 disposed at a first end 54 of the fourth section decorative panel and a fourth section bottom flap 56 disposed at a second end 58 of the fourth section decorative panel. Finally, the blank 10 includes a tab 60 connected to a third end 62 of either the first section decorative panel 14 or the fourth section decorative panel 50. Tab 60 is utilized to secure the fourth section decorative panel 50 to the first section decorative panel 14 in constructing a container that can be made from the blank 10. To form the container, the blank is folded along a plurality of lines 63 illustrated by the dashed line having long and short dashes.

Figure 6:
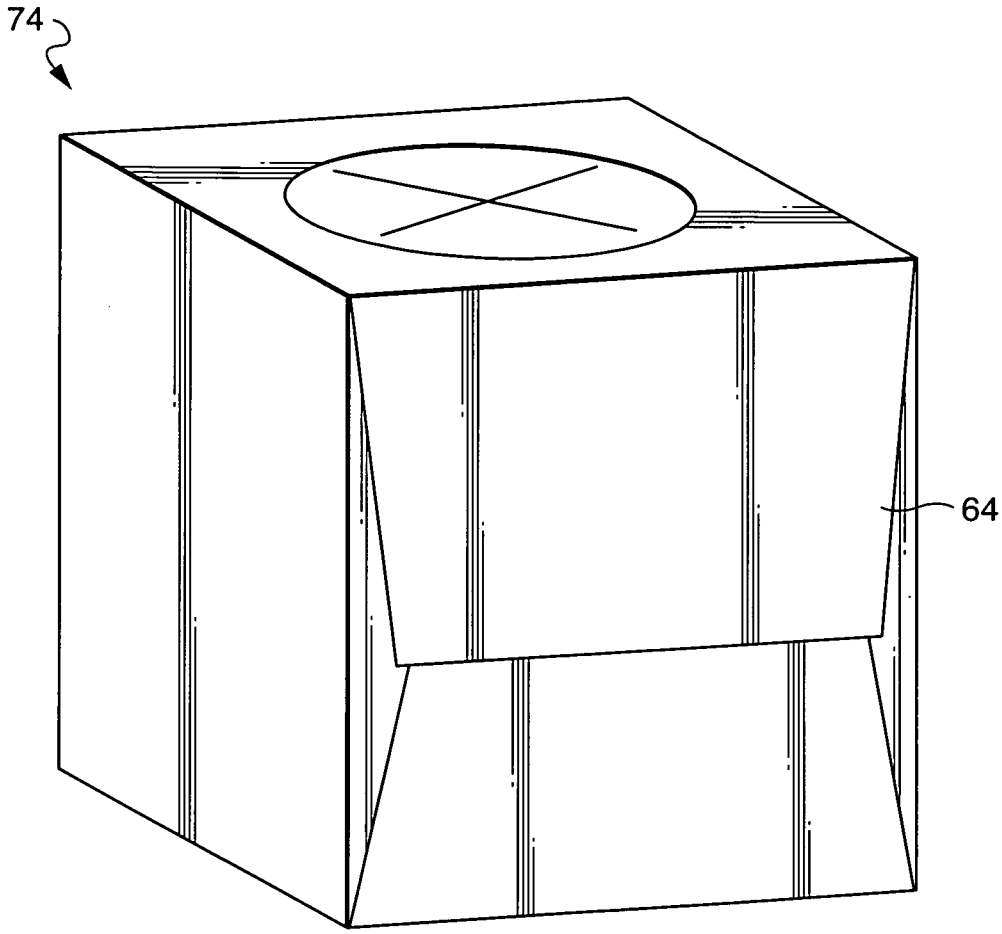
FIG. 6 (PRIOR ART)
FIG. 6 illustrates a prior art upright facial tissue carton.

The first, second, third and fourth section decorative panels form a sidewall 64 of the container having a continuous decorative surface 66 between the arrowheads on the longitudinal center line. The continuous decorative surface can be on the interior or the exterior of the container, but is typically on the exterior of the container. Continuous surface 66 is referred to as a continuous decorative surface in that it can receive vector or graphic art in, for example, printed form, to maximize a visual effect to a consumer. Advantageously by spanning across several decorative panels, the registration problems that typically occur as a result of having the closing flaps forming at least a portion of the container's sidewall, as seen in the prior art upright tissue carton of FIG. 6, is eliminated. The flaps on the sidewall can interrupt a continuous design that is placed onto the sidewall since the top and bottom flap must be folded perfectly to meet with each other and the remainder of the container such that the registration of the design is not interrupted. In prior upright dispensers, the flaps may not be perfectly folded and sealed such that the graphics on the flaps aligns with the graphics on the other decorative panels forming the sidewall. Moreover, when the flaps form a portion of the sidewall, discontinuous boundaries result at the flaps that impedes the visual unity of any graphics design applied to the container's sidewall.

The blank further includes a dispensing opening 68 and optionally includes a dispensing window 70. For loading on an automated carton line, the dispensing widow should be pre-attached to the carton blank by attaching the dispensing window to either the inside or the outside of the top flap, preferably on the inside on as shown. The dispensing window can be made from a suitable sheet materials such as a film, nonwoven, or paper material that can retain a partially a dispensed sheet, such as a facial tissue, within the dispensing opening for pop-up dispensing. The dispensing window 70 has a dispensing orifice 71 that can be a slit; a curvilinear line; a geometric shape such as an oval, a circle, or a triangle; or X shaped, + shaped or H shaped orifice. Alternatively, the dispensing window can be eliminated and fingers or tabs projecting into the dispensing opening 68 can be used to retain a partially dispensed sheet.

The dispensing opening 68 can be any size or shape such as square, circular, or oval. The dispensing opening can be located such that it resides entirely in one of the top flaps or the dispensing opening can be located such that a portion resides in one of the top flaps and another portion resides in one of the decorative panels. By having the dispensing opening span portions of the top flap and decorative panel, the amount of board material utilized to form the carton can be minimized. Thus occurs since the overall size of the top flaps can be decreased because less material is needed to surround the dispensing opening. Additionally, by having the dispensing opening span portions of the container top and decorative panel, a unitary or one piece dispensing window can be used that simplifies the overall construction of the carton and allows for maximum flexibility in choosing the shape of the dispensing orifice. By unitary it is meant that the dispensing window is a single continuous piece rather than formed from two or more pieces that meet or overlap. Because the window is unitary, any desired shape for the dispensing orifice can be cut into the window without concern of having separate pieces meet or join together to form the dispensing orifice and/or dispensing window.

The blank further includes an optional removable surfboard 72 that can be attached to the top flaps by a perforated or weakened line. The removable surf board can be used to prevent foreign materials from entering the assembled container and provides protection for the more fragile dispensing window during loading and shipping. The blank can also include and optional film wrapper 72 (FIG. 2) that can span any of the decorative panels (14, 26, 38, and 50) by attaching the opposing ends of the film wrapper to the top and bottom flaps of the chosen decorative panel. By attaching the film wrapper 72 to a pair of opposing minor flaps, such as minor flaps 28 and 32 to span decorative panel 26 or minor flaps 52 and 56 to span decorative panel 50, the attached ends of the film wrapper can be hidden from view under the major top and bottom flaps after the container is assembled. The film wrapper can be perforated near both ends to permit easy removal. Additionally, other sheet materials beside film can be used to construct the wrapper 72. The film wrapper can be used to display printed information such as a prominent trademark that can identify the manufacturer at the point of purchase, which then later can be removed by the consumer so as not to detract from the continuous graphic design on the sidewall 64 of the container.

The blank of FIG. 1. is well suited to filling on an automated cartoner since the blank is substantially symmetrical about its longitudinal center line. By "symmetrical" is meant the transverse distance measured perpendicularly from the longitudinal centerline to either opposing edge of the blank is approximately the same at any point along the longitudinal centerline. Thus, even though the dispensing opening only appears in the top flaps, those top flaps having the opening are approximately the same length as the corresponding bottom flaps thereby maintaining the blank's symmetry. The symmetry helps in guiding the carton sleeve (the blank folded in half and with the tab 60 attached to the fourth decorative panel 50) though a cartoner by the exposed top and bottom flaps. If the blank is too asymmetrical, then specialized or custom magazines are needed to hold the carton sleeves for feeding the orbital carton opener. Additionally, customized or reconfigured rails within the cartoner are needed to open, close, or guide the top or bottom flaps that stick out proportionally too far from the decorative panels (14, 26, 38, and 50) relative to the other flaps. Thus, major changes and additional money must be spent to run asymmetrical cartons on pre-existing cartoners. Furthermore, asymmetrical cartons are more prone to jam ups and mishandling while traveling through the cartoner since the forces acting on the various flaps and portions of the carton are not balanced as they would be in a symmetrical carton blank.

In the illustrated embodiment, for each decorative panel (14, 26, 38, and 50), the length, L1, of the corresponding top flap (16, 28, 40, and 52) as measured from the corresponding fold line to its most distal end is approximately the same as the length of the corresponding bottom flap, L2, (20, 32, 44, and 56) when measured in the same manner. The degree of non-symmetry for the flaps can be expressed as a Symmetry Ratio of the top flap length, L1, divided by the bottom flap length, L2, for any corresponding pair of opposing top and bottom flaps. For improved handling on an automated cartoner, the Symmetry Ratio should be between about 0.7 to about 1.3, or between about 0.8 to about 1.2, or between about 0.9 to about 1.1. In the illustrated embodiment, the Symmetry Ratio corresponding to the top and bottom flap pairs of the first and third sections (12 and 36) is approximately 1.0. The Symmetry Ratio corresponding to the top and bottom flap pairs of the second and fourth sections (24 and 48) is approximately 1.1.

The carton blank 10 can be designed such that there are major flaps and minor flaps. The major flaps have a longer over length the minor flaps. In the illustrated embodiment, the major flaps are 16, 20, 40, and 44 while the minor flaps are 28, 32, 52, and 56. Alternatively, the carton can be designed such that all the flaps are approximately the same length. To minimize the carton material required, the major flaps are designed to have a length that is approximately ½ the width between opposing decorative panels in the assembled container. In this manner, the major flaps will just meet or slightly overlap when folded over to form either the top or the bottom of the container. While extra material can be used, such as a top or bottom flap that spans the entire end of the container, more board is needed resulting in a more expensive carton and reduced nesting of adjacent blanks during the printing and die cutting process. To further reduce the board material required, the minor flaps should be made as short as possible while still allowing for efficient opening and closing of the flaps on automated cartoner. The minor flaps also need to be large enough such that a sufficient attachment area is present to hold the flaps in a closed and sealed position after filling the container. For improved handling on an automated cartoner, the minor flaps should have a minimum length that is approximately 40 percent the length of the major flaps and not less than about 20 mm, or less than about 25 mm, or less than about 30 mm, or less than about 35 mm. Minor flaps that are too short require special scoring during fabrication to reduce the bending forces required and also limit the seal attachment area. The minor flaps can be made as long as necessary for closing the carton, but should not be made so short as to cause problems opening and closing the flap and then sealing it shut on automated equipment.

Figure 2:
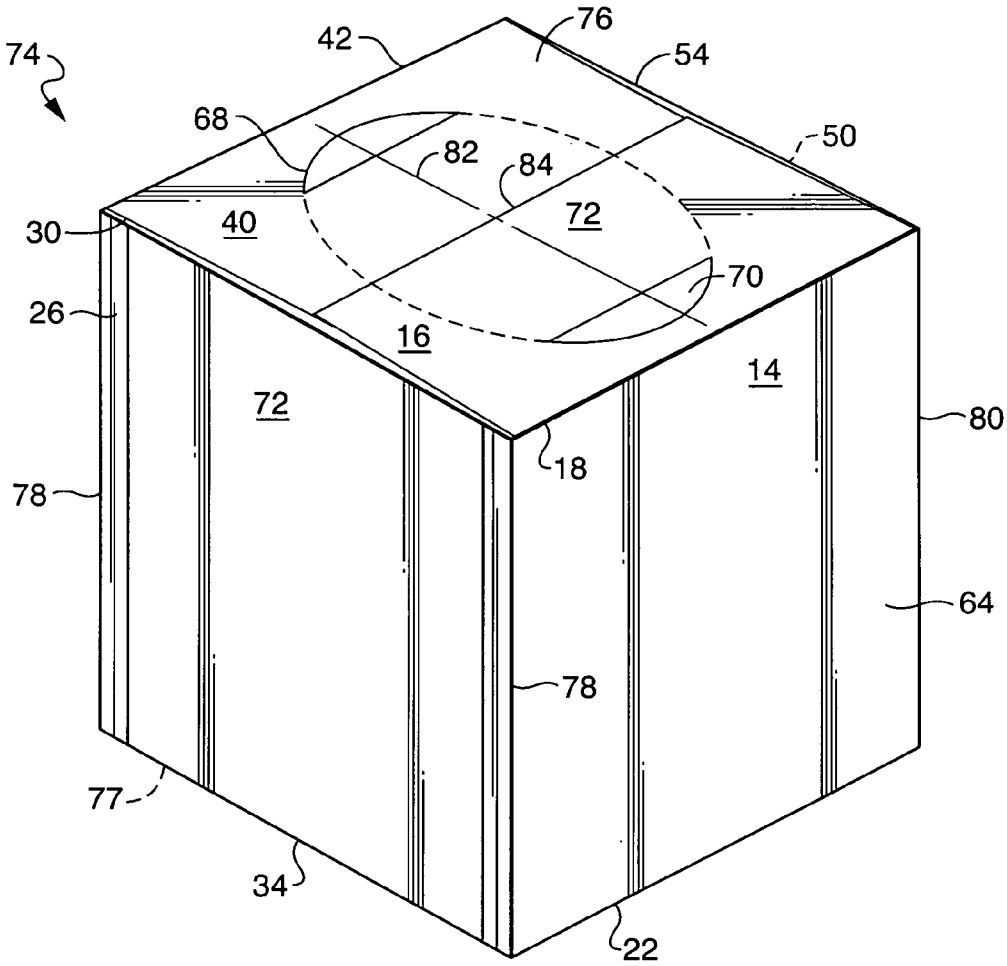
FIG. 2 illustrates a perspective view of a container made from the blank of FIG. 1.

FIG. 2 shows a perspective view of a container 74 that can be formed from blank 10 of FIG. 1. In one embodiment, the container comprised an upright tissue carton and housed a plurality of facial tissue sheets. Shown are the first section decorative panel 14 and the second section decorative panel 26, the first section top flap 16, and the third section top flap 40. The top flaps form a container top 76 and the bottom flaps form a container bottom 77. In the completed container 74, decorative panels 14 and 26 are folded so as to be in side fold continuity across an edge 78, and by this it is meant that there is a continuity of material (which used to create or form the continuous decorative surface described previously). The exterior of the container, and in particular the continuous decorative surface 66, is particularly well suited for receiving commercially suitable decoration, such as image, print, indicia, graphics, fresnel lens, lenticular lens, color, an embossed area, a debossed area, and/or coating(s). The sidewall 64 of the container formed by the decorative panels (14, 26, 38, and 50) is side fold continuity across three of the four edges joining the four panels forming the sidewall with the exception of the interruption where the fourth decorative panel 50 is joined to the first decorative panel 14 at edge 80.

The manner in which the completed container 74 is folded is an important aspect of whether the container is well suited to running on an automated cartoner. By folding the container 74 such that minor flaps (28, 32, 52, and 56) are first folded to partially close the container's ends and then folding the major flaps (16, 20, 40, and 44) to form the top and bottom of the container, the container can be closed and sealed by most existing cartoners. Thus results from the orientation of the carton as it moves though the carton loading sequence. While it is possible to close the major flaps first and then the minor flaps second, existing cartoners would have to be rebuilt in order to change the flap opening and closing sequence.

Closing the major flaps last is also useful for when lenticular material or grooved material is applied to the exterior surface of the blank 10. Since the lenticular material has a grain direction, a discontinuous container top is prevented by folding the major flaps over the minor flaps. If the minor flaps are folded over the top of the major flaps, the grooves of the lenticular material on the minor flaps would be aligned 90 degrees to the grooves on the major flaps on the container top 76. This would result in an undesirable look for the top of the container since the graphical effect of the lenticular material is dependant on the orientation of the viewer and the direction of the grooves. If the grooves are not all aligned in the same direction on all the visible flaps forming the container top, the lenticular effect is diminished.

Thus for the illustrated folding sequence, the major flaps (16, 20, 40, and 44) are in top and bottom fold continuity across the first and second ends (18 and 22) of the first decorative panel 14 and across the first and second ends (42 and 46) of the third decorative panel 38. The design is interrupted at the first and second ends (30 and 34) of the second decorative panel 26 and at the first and second ends (54 and 58) of the fourth decorative panel 50. As seen, the discontinuity between the edges of the top flaps forming the container top 76 and the first edge 30 of the decorative panel 26 is minimal and can be further reduced by reducing the taper of the top flaps. Notice how the bottom flaps 20 and 44 are quite tapered while the corresponding top flaps 16 and 40 barely taper in FIG. 1. The amount of taper of the flap controls, to some extent, the perceived interruption in the design where the edges of the top or bottom flaps meet with the decorative panels.

By folding the major flaps first and then covering the major flaps with the minor flaps it is possible to achieve more top and bottom fold continuity around the top and bottom perimeters of the container. If the minor flaps are exposed on the container top, it can be advantageous to taper the minor flaps much more than shown such as having the edges of the minor flaps intersect with the respective fold line at an approximately 45 degree angle. Alternatively, the edges of the minor flaps can be scalloped, curved, rounded, or another decorative shape. If it is necessary to fold the minor flaps over the major flaps, it is possible to rebuild a cartoner line to fold the flaps in this manner.

Referring back to FIG. 1, the dispensing opening 68, the dispensing window 70, the dispensing orifice 71, and the surf board 72 are formed in halves with approximately ½ of each residing on the first section top flap 16 and the third section top flap 40. This arrangement reduces the amount of board material needed to make the blank and also has advantages for folding the blank on an automated cartoner. The orientation of the dispensing opening 68 and the location of the dispensing window 70 are controlled to ensure the carton is well suited to running on an automated cartoner.

In particular, the dispensing opening 68 when completely formed has a major axis 82 and a minor axis 84 corresponding to the maximum length and the maximum width of the dispensing opening. If the dispensing opening is oval as shown, then the major axis corresponds to the longitudinal central axis of the oval with the minor axis perpendicular to the major axis and corresponding with the transverse central axis of the oval as best seen in FIG. 2. The major axis of the dispensing opening intersects and bisects the top major flaps and the minor axis of the dispensing opening intersects and bisects the top minor flaps. For differently shaped dispensing openings, the major and minor axes may not be perpendicular. The dispensing opening is cut into the two major top flaps (16, 40) forming the dispensing opening 68 by orientating the minor axis of the opening parallel to the longitudinal central axis on decorative surface 66. Thus, the longest dimension forming the dispensing opening is oriented in the length direction, L1, of the major flaps such that in the folded carton the minimum width of the dispensing opening is positioned between the top minor flaps. This ensures the minor top flaps (28 and 52) can be made longer without interfering with the dispensing opening since the dispensing opening 68 has its minimum width situated between the minor top flaps in the folded container. Thus, the container has improved runnability in a cartoner because the minor top flaps can have a longer length for a given sized dispensing opening.

As seen in FIG. 1, the minor top flaps (28 and 52) need only a slight recess to clear the dispensing opening leaving a significant amount of material between the recess and the corresponding decorative panel (26 and 50). In comparison, the dispensing opening 68 cut into the major top flaps 16 and 40 is cut much closer to the corresponding decorative panels (14 and 38). Thus, with the opening designed in this manner it is much easier to achieve the required minimum flap length without having to reduce the size of the dispensing opening.

Additionally, with the dispensing opening designed in this manner and the major flaps closed over the minor flaps, the area where the graphics on one major flap meets the other major flap is reduced. Since the surf board 72 is removed, only the small narrow areas where the major flaps meet on either side of the dispensing opening 68 need to be registered as seen in FIG. 2. Most of the area where the major flaps meet is removed and thrown away by the user. Thus, with the opening designed in this manner, the graphics registration is less sensitive.

Figure 3:
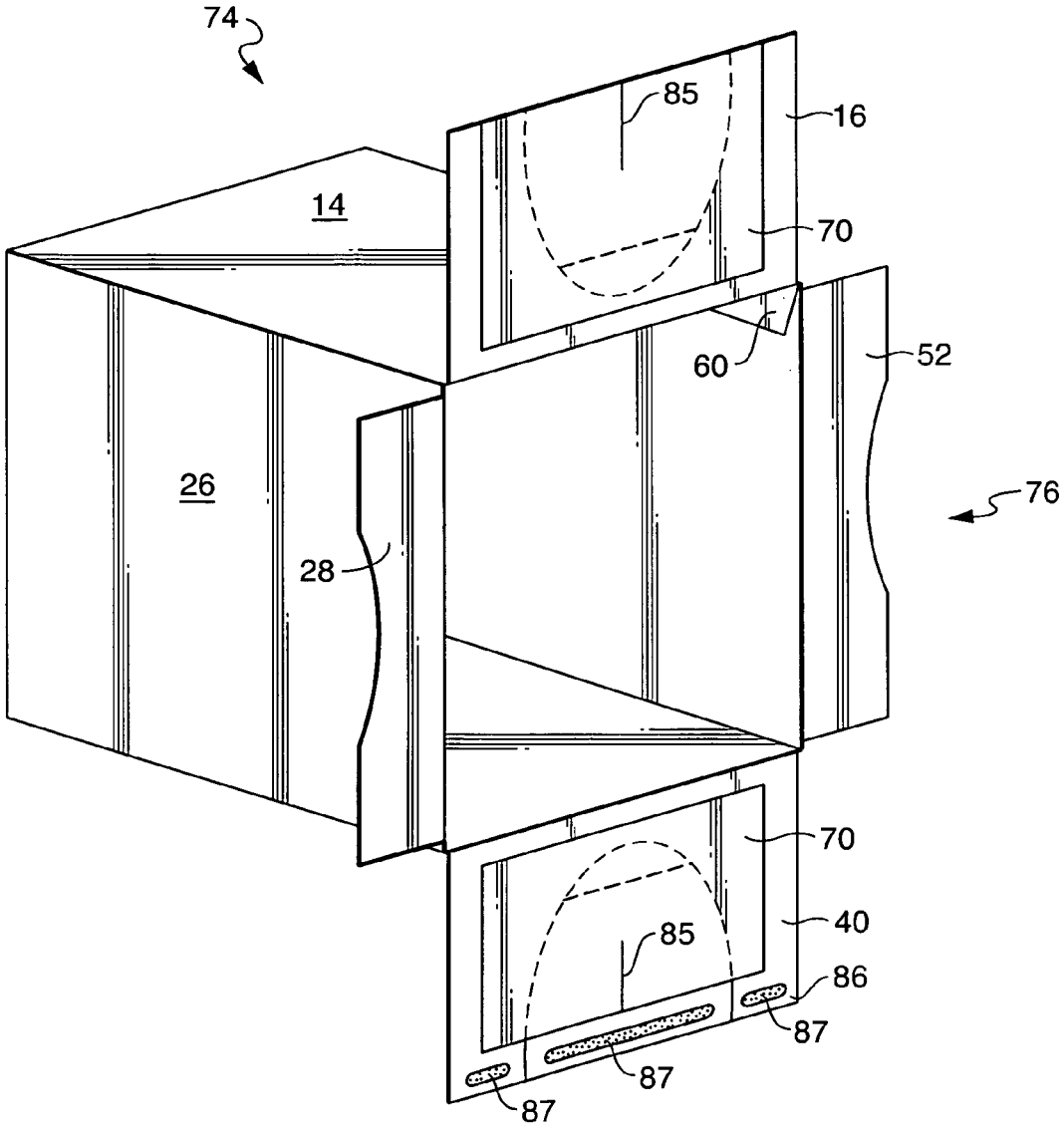
FIG. 3 illustrates a perspective view a partially assembled container made from the blank of FIG. 1.

Referring now to FIG. 3, a partially assembled container 74 with the container top 76 open for filling on a cartoner is shown. On an automated cartoner, the container 74 would be held by transport lugs on a carton conveyer and moving in synchronized motion with a bucket conveyor holding a clip of sheet material. The clip would then be pushed into the open end of the container and the top flaps closed to form the container top 76. Because the flaps of the blank 10 are substantially symmetrical, the container's orientation within the transport lugs can be rotated 180 degrees such that either the top or the bottom of the container can be loaded by being placed adjacent to the bucket conveyor. There is no impact to the flap folding and gluing sequence to the cartoner from either container orientation. This allows for loading of the sheet material into the container such that a choice of dispensing from the container is possible. The clip can be loaded such that either the curved center outside portion of the folded clip can be placed adjacent the dispensing opening, or the ends of the folded clip can be placed adjacent the dispensing opening. This offers a choice of having the first sheet and subsequent sheets being dispensed from the center of the clip or from the outside of the clip for improved dispensing depending of the type of sheet material or the number of sheets within the clip.

To further adapt the container to automated filling on a cartoner, the dispensing window 70 applied to at least one of the major flaps is applied such that the distal end 86 of the major flap is not covered by the dispensing window. This serves two useful purposes for adapting the container to an automated cartoner. First, an adhesive 87 can now be applied across the distal end of the major flap to join together the two pieces forming the surf board 72 into a single piece that can easily be removed. The adhesive is also used to hold the top flaps in a closed position.

Second, by ending the dispensing window 70 end short of the distal end 86, a dispensing slit or orifice is automatically created when the major flaps (16 and 40) are folded shut. By controlling how close the dispensing window 70 comes to the distal end 86, a slit can be formed between the two pieces forming the dispensing window after the major top flaps are folded and glued down to automatically create a dispensing orifice 71. The width of the dispensing silt can be adjusted in the final folded container by selecting the placement and size of the dispensing window applied to each major top flap. After the major top flaps are folded shut, the dispensing slit is aligned automatically with the minor axis of the dispensing opening.

To close the container, the minor top flaps 28 and 52 are first folded inward. Then adhesive 87 can be applied across the distal end 86 of the major top flap 40. Then major top flap 16 is first folded shut and the major top flap 40 is then bought into contact with the exterior of major flap 16. This glues the two piece surf board 72 together and seals the flap shut. Additional adhesive can be placed onto other portions of the flaps to seal the container as needed. Because, the dispensing window 70 adhered to the flap 16 does not meet or touch the dispensing window 70 adhered to the flap 40 after the flaps are folded shut, a slit is automatically created for use as a dispensing orifice 71 to dispense the sheet material.

If desired, additional slits 85 can be cut or perforated perpendicular to the free ends of the dispensing window 70. This would create a cross shaped (+) dispensing orifice 71 in the final assembled container. Alternatively, the two pieces forming the dispensing window can be extended to or beyond the ends of the major top flaps (16 and 40) to form an overlapped dispensing orifice where one layer of the dispensing window would partially overlap the other layer. Containers of this design can be sealed by slowing the cartoner's speed, if needed, while pulsing the adhesive application to avoid the placement of the adhesive on the dispensing window.

Figure 4:
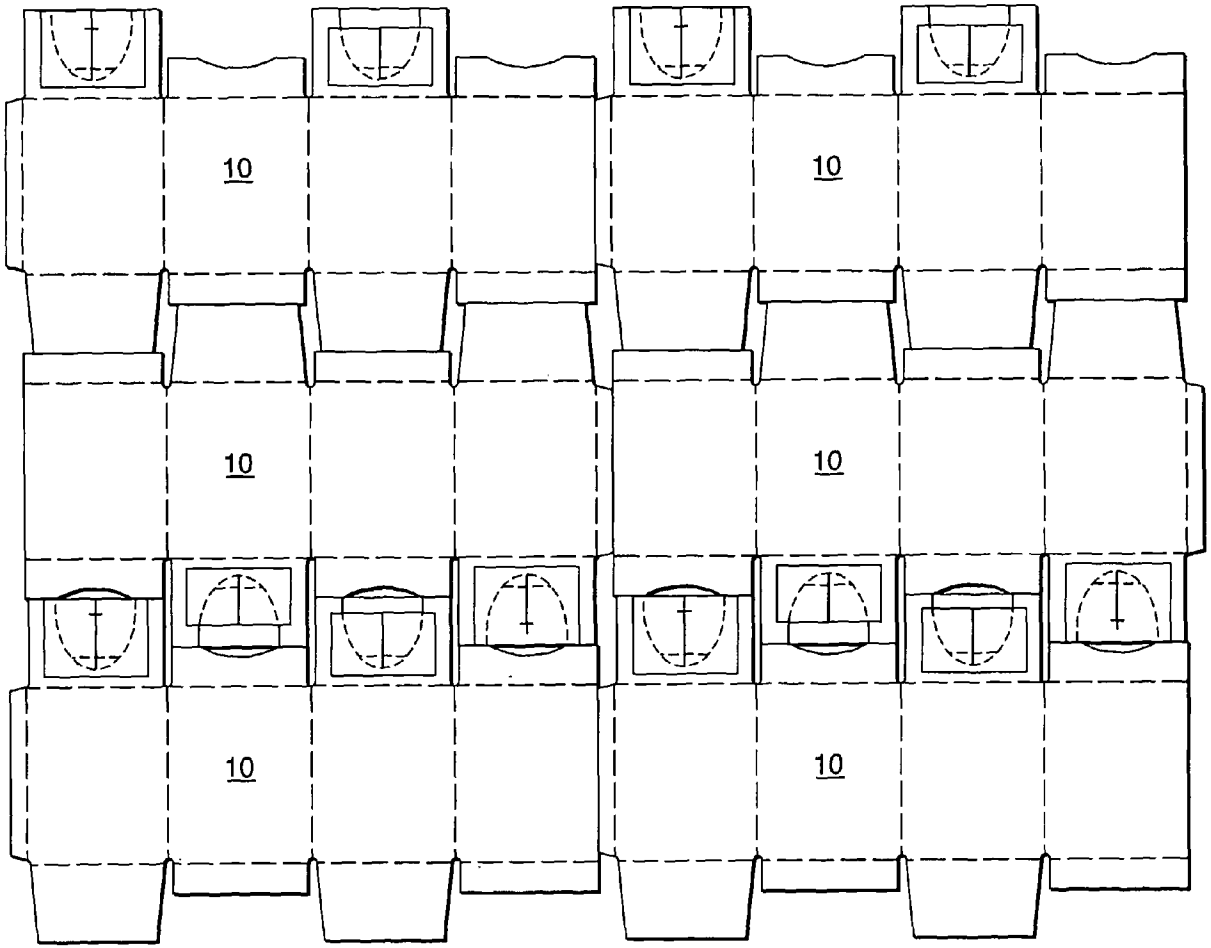
FIG. 4 illustrates a die cut layout of multiple blanks of FIG. 1.

Referring now to FIG. 4, a die cut layout of multiple blanks is illustrated showing how the blank of FIG. 1 can be staggered and rotated to improve overall utilization of the board stock while minimizing waste. As seen, reducing the length of the minor flaps to the absolute minimum allows for closer nesting of multiple blanks. Similarly, reducing the length of the major flaps to the minimum needed to just meet and form the container's top or bottom reduces the amount of board material consumed.

Figure 5:
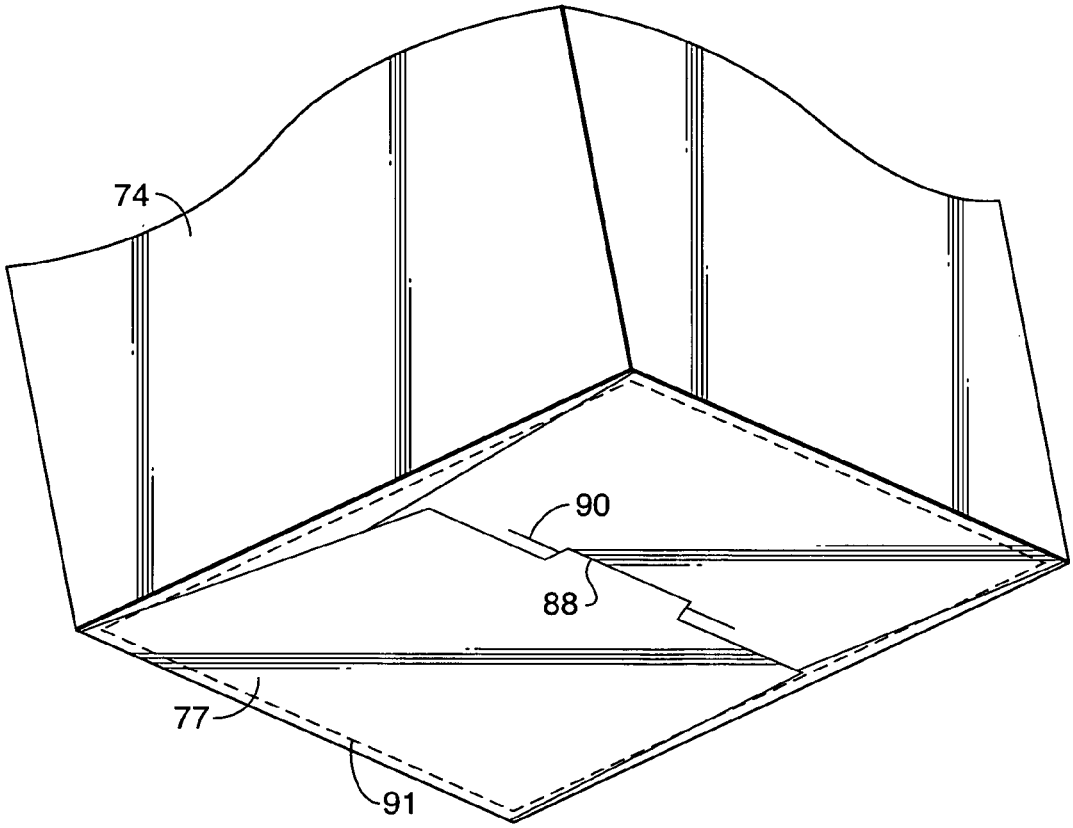
FIG. 5 illustrates a perspective view of an alternative embodiment of the container's bottom.

Referring now to FIG. 5, an alternative embodiment of the container bottom 77 is illustrated. The container bottom is designed such that it can be opened and closed instead of being permanently glued shut. In one embodiment, the bottom is opened and closed by use of a closing tab 88 on one major bottom flap and a tab slot 90 on the opposing major bottom flap. This allows for the container to be refilled with new sheet material when depleted. Unlike the prior art tissue carton of FIG. 6, an opening and closing bottom is much more feasible since it is hidden from view and the weight of the container helps to keep the bottom tightly closed. In the prior art carton, the graphical interruption in the sidewall 64 by including an opening and closing feature was considered unacceptable to many people who used the container. Alternatively, the container 74 can be designed slightly larger such that upon depletion, the prior art carton of FIG. 6. can be inserted into container 74 and the bottom flaps closed to hold the prior art carton inside. Alternatively, a specific refill carton housing the sheet material that is slightly smaller can be made and sold such that another manufacturer's carton will not fit into the container 74. Thus, a more expensive container having an expensive graphical treatment on the exterior can be sold since consumers may be willing to pay the increased costs of the container if it was also reusable or refillable. In other embodiments, the container's bottom can be opened and closed by use of other fasteners such as hook and loop material, pressure sensitive adhesives, magnets, pins, or screws. In another embodiment, the container's bottom flaps can be joined to the decorative panels by perforations or weakened lines 91 such that the bottom flaps can be easily removed from the container to form a sleeve, having an open end that can be placed over the prior art carton of FIG. 6. The container 74 can be sized such that the sleeve has a modest press fit or slight interference when placed over the prior art carton of FIG. 6 to better hold the refill carton within the sleeve.

The container can be made from suitable materials which includes, without limitation, cardboard, carton stock, paper board, polypropylene, polyethylene, polystyrene, ABS plastic, plastic, metal, wood, and glass, amongst other suitable alternatives. In a preferred embodiment, the container is made from 0.5 mm thick clay coated news board.

Other modifications and variations to the present invention may be practiced by those of ordinary skill in the art, without departing from the spirit and scope of the present invention, which is more particularly set forth in the appended claims. For example, three, five, six or more decorative panels can form the sidewall 64 to form differently shaped geometric containers instead of the four illustrated. Standard flat tissue containers can be constructed in the manner described.

Another container for facial tissue is described in U.S. patent application 2004/0144795 entitled In-Line Windowed Facial Tissue Carton filed by Gerald Keberlein on Jul. 3, 2003 and herein incorporated by reference. An additional container is described in a co-pending patent application entitled Top or Bottom Loading Container that was filed on Sep. 4, 2004 and assigned U.S. patent application Ser. No. 10/993,093 and herein incorporated by reference.

It is understood that aspects of the various embodiments may be interchanged in whole or part. All cited references, patents, or patent applications in the above application for letters patent are herein incorporated by reference in a consistent manner. In the event of inconsistencies or contradictions between the incorporated references and this application, the information present in this application shall prevail. The preceding description, given by way of example in order to enable one of ordinary skill in the art to practice the claimed invention, is not to be construed as limiting the scope of the invention, which is defined by the claims and all equivalents thereto.

We claim:

1. A container comprising:

at least four decorative panels forming a continuous decorative surface that extends in side-fold continuity across a plurality of edges where adjacent decorative panels meet except at an edge where the first decorative panel is joined to the fourth decorative panel, the decorative panels forming a sidewall of the container;

a plurality of top flaps extending from the decorative panels and folded to form a container top having a dispensing opening, the plurality of folded top flaps comprising two oppositely disposed major top flaps and two oppositely disposed minor top flaps; and a two-section film dispensing window;

wherein approximately half of the dispensing opening is located in each major top flap such that when the two major top flaps are folded closed they form the dispensing opening and one major flap overlaps the opposite major flap when closed to facilitate gluing;

wherein the dispensing opening formed when closing the major and minor flaps is oval-shaped with a major axis and a minor axis with the minor axis of the dispensing opening intersecting the oppositely disposed minor top flaps on the container top; and wherein one section of the two-section dispensing window is pre-attached to each major top flap.

2. The container of claim 1 wherein the dispensing opening comprises an oval.

3. The container of claim 1 comprising a removable surf board wherein at least a portion of the surf board is located in each major top flap and the two pieces overlap when the flaps are closed to facilitate gluing.

4. The container of claim 1 wherein on at least one of the major top flaps, one section of the dispensing window ends short of a distal end of that major flap.

5. The container of claim 1 in containing a plurality of sheet materials.

6. The container of claim 1 wherein the container is an upright tissue carton containing a plurality of tissue sheets.

* * * * *